United States Patent [19]

Yaguchi et al.

[11] Patent Number: 4,798,820

[45] Date of Patent: Jan. 17, 1989

[54] THERMOSENSITIVE RECORDING MATERIAL

[75] Inventors: Hiroshi Yaguchi; Hiroshi Sakamoto, both of Numazu, Japan

[73] Assignee: Ricoh Company Ltd., Tokyo, Japan

[21] Appl. No.: 890,554

[22] Filed: Jul. 30, 1986

[30] Foreign Application Priority Data

Aug. 10, 1985 [JP] Japan ..... 60-176382

[51] Int. Cl.[4] ..... B41M 5/26

[52] U.S. Cl. ..... 503/207; 427/152; 428/484; 428/488.1; 428/488.4; 428/913; 503/200; 503/214; 503/226

[58] Field of Search ..... 427/150–152; 503/200, 226, 207, 214; 428/484, 488.1, 488.4, 914

[56] References Cited

U.S. PATENT DOCUMENTS 4,370,370 1/1983 Iwata et al. ..... 428/40

FOREIGN PATENT DOCUMENTS 0116692 7/1982 Japan ..... 346/226
1035281 2/1986 Japan ..... 346/226
1089883 5/1986 Japan ..... 346/226

*Primary Examiner*—Bruce H. Hess
*Attorney, Agent, or Firm*—Oblon, Fisher, Spivak, McClelland & Maier

[57] ABSTRACT

A thermosensitive recording material is disclosed which comprises (a) a support material, (b) a plurality of undercoat layers successively overlaid on the support material, and (c) a thermosensitive recording layer formed on the undercoat layers.

14 Claims, No Drawings

THERMOSENSITIVE RECORDING MATERIAL

BACKGROUND OF THE INVENTION

The present invention relates to a thermosensitive recording material which is improved on the recording sensitivity and the whiteness of the background thereof.

The thermosensitive recording material according to the present invention comprises (a) a support material, (b) a plurality of undercoat layers successively overlaid on the support material, and (c) a thermosensitive recording layer formed on the undercoat layers.

A conventional thermosensitive recording material comprises a support material, for example, a sheet of ordinary paper or synthetic paper, and a thermosensitive recording layer formed on the support material. Colored images can be readily formed by image-wise application of heat. A recording apparatus for use with the thermosensitive recording material is relatively simple in mechanism and compact in size and inexpensive in maintenance. Due to such advantages of the recording apparatus and the ability to form colored images by simple application of heat, such thermosensitive recording materials are widely used for recording a variety of information.

However, conventional thermosensitive recording materials still have the shortcomings that the thermal response, that is, thermal recording sensitivity, is insufficient for high speed recording, and that the whiteness of the background of the recording materials is not high.

The inventors of the present invention discovered that the thermal recording sensitivity can be improved to some extent by interposing an undercoat layer between the support material and the thermosensitive recording layer, so that a variety of undercoat layers were proposed, for instance, as disclosed in Japanese Laid-Open Patent Applications No. 55-86789, No. 55-140590, No. 56-27394, No. 56-44687 and No. 59-225987.

It is desired that the undercoat layer interposed between the support material and the thermosensitive recording layer has at least the following three functions, (i) smoothing the surface of the support material, (ii) facilitating the smoothing of the surface of the thermosensitive recording layer when the layer is subjected to calendering, and (iii) hindering the diffusion of heat from the thermosensitive recording layer to the support material at image-wise application of heat to the recording layer, thereby attaining effective use of the applied heat and sharp image formation in the recording material.

In the thermosensitive recording materials disclosed in the above Japanese laid-open patent applications, a single undercoat layer is employed. In this case, however, it is not always easy or sometimes impossible to attain the above three functions simultaneously by the single undercoat layer, since the components necessary for attaining the three functions, when all mixed, may work so as to cancel their desired effects. Furthermore, it is difficult to make a single, uniformly thin undercoat layer when all the necessary components for attaining the three functions are contained in the single undercoat layer. When the undercoat layer does not perform the above functions, the thermosensitive recording material does not attain high thermal recording sensitivity and high whiteness of the background of the recording material.

SUMMARY OF THE INVENTION

It is therefore an object of the present invention to provide a thermosensitive recording material which is improved so as to attain high thermal recording sensitivity and high whiteness of the background thereof.

The thermosensitive recording material according to the present invention comprises (a) support material, (b) a plurality of undercoat layers successively overlaid on the support material, and (c) a thermosensitive recording layer formed on the undercoat layers.

In the present invention, a plurality of undercoat layers each have at least one of the following main functions: (A) smoothing the surface of the support material, thereby attaining the formation of a uniformly thin thermosensitive recording layer on the support material, (B) facilitating the smoothing of the surface of the thermosensitive recording layer when the thermosensitive recording layer is subjected to calendering, thereby preventing the occurrence of fogging in the thermosensitive recording layer by the application of pressure at the time of caledering, and (C) minimizing the heat diffusing from the thermosensitive recording layer to the support material at image-wise application of heat to the thermosensitive recording layer for image formation, thereby attaining the formation of sharp images.

By interposing such a plurality of undercoat layers between the support material and the thermosensitive recording layer, the thermal recording sensitivity is increased and the coloring of the background is prevented so as to attain high whiteness of the background.

DETAILED DESCRIPTION OF THE PREFERRED EMBODIMENTS

According to the present invention, an undercoat layer having as the main function the above function (A) can be prepared, for example, by coating on the support material a dispersion comprising a finely-divided filler, preferably a filler having an average particle size of 5 μm or less, more preferably a filler having an average particle size of 2 μm or less, and a binder agent as will be exemplified later.

An undercoat layer having as the main function the above function (B) can be prepared, for example, by coating on the support material or on the above undercoat layer a material which can be deformed plastically upon application of pressure thereto as in calendering, for example, a wax and a wax-like polymeric material, and a binder agent.

An undercoat layer having as the main function the above function (C) can be prepared, for example, by coating on the support material or one of the above undercoat layers a dispersion comprising a filler whose particles are sphere and uniform in particle size, for example, styrenemethacrylic acid copolymer filler and polystyrene filler, and a binder agent, thereby forming an undercoat layer (C1) having high void or voidage, or by coating a dispersion comprising a filler having low thermal conductivity such as fine, hollow particles made of glass, ceramics, or plastics, and a binder agent, thereby forming an undercoat layer (C2) having low thermal conductivity. These undercoat layers (C1) and (C2) can also be separately formed.

The above undercoat layers have not only the above-mentioned respective main functions, but also the other functions that the other undercoat have. Therefore, the overlaying order of the above undercoat layers can be changed as desired. Further, each undercoat layer can be formed in the form of a plurality of layers when a plurality of the same layers is overlaid by coating thinly a plurality of times, each layer can be made more uniform in thickness than in the case where one layer is formed by a single coating process. Furthermore, of the above three different layers, the components for any combinations of two layers can be mixed to form one undercoat layer, with which the remaining layer can be combined to form a plurality of undercoat layers interposed between the support material and the thermosensitive recording layer.

Specific examples of a finely-divided filler for use in the undercoat layers of the thermosensitive recording material according to the present invention are finely-divided inorganic powders of calcium carbonate, silica, zinc oxide, titanium oxide, aluminum hydroxide, zinc hydroxide, barium sulfate, clay, talc, surface-treated calcium carbonate and surface-treated silica, and finely-divided organic powders of urea-formaldehyde resin, styrene/methacrylic acid copolymer and polystyrene.

Specific examples of a binder agent for use in the undercoat layers are water-soluble polymeric materials such as polyvinyl alcohol, starch, starch derivatives, cellulose derivatives such as methoxycellulose, hydroxyethylcellulose, carboxymethylcellulose, methylcellulose and ethylcellulose, sodium polyacrylate, polyvinyl pyrrolidone, polyacrylamide/acrylic acid ester copolymer, acrylamide/acrylic acid ester/methacrylic acid copolymer, styrene/maleic anhydride copolymer alkali salt, isobutylene/maleic anhydride copolymer alkali salt, polyacrylamide, sodium alginate, gelatin and casein, and latexes of polyvinyl acetate, polyurethane, styrene/butadiene copolymer, polyacrylic acid, polyacrylic acid ester, vinyl chloride/vinyl acetate copolymer, polybutylmethacrylate, ethylene/vinyl acetate copolymer and styrene/butadiene/acrylic derivative copolymer.

Specific examples of a wax and a wax-like polymeric material which are easily deformed by application of pressure are vegetable waxes such as carnauba wax and castor wax; animal waxes such as bees wax and shellac wax; mineral waxes such as montax wax; petroleum waxes such as polyethylene wax, microcrystalline wax and paraffin wax; and synthetic waxes such as polyhydric alcohol esters of higher fatty acids, higher fatty ketones, higher fatty amines, higher fatty amides, condensates of higher fatty acids and amines, synthetic paraffin and paraffin chloride.

In the thermosensitive recording layer of the thermosensitive recording material according to the present invention, a variety of conventional thermosensitive coloring systems can be employed. A representative thermosensitive coloring system is one comprising a leuco dye and a color developer capable of inducing color formation upon application of heat thereto.

As the leuco dyes for use in the present invention, any conventional leuco dyes for use in conventional thermosensitive recording materials can be employed. For example, example, triphenylmethane-type leuco compounds, fluoran-type leuco compounds, phenothiazine-type leuco compounds, auramine-type leuco compounds and spiropyran-type leuco compounds are preferably employed.

Specific examples of those leuco dyes are as follows:

3,3-bis(p-dimethylaminophenyl)-phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)-phthalide,
3-cyclohexylamino-6-chlorofluoran,
3-dimethylamino-5,7-dimethylfluoran,
3-diethylamino-7-chlorofluoran,
3-diethylamino-7-methylfluoran,
3-diethylamino-7,8-benzfluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran,
2-[N-(3'-trifluoromethylphenyl)amino]-6-diethylaminofluoran,
2-[3,6-bis(diethylamino)-9-(o-chloroanilino)xanthylbenzoic acid lactam],
3-diethylamino-6-methyl-7-(m-trichloromethylanilino)fluoran,
3-diethylamino-7-(o-chloroanilino)fluoran,
3-dibutylamino-7-(o-chloroanilino)fluoran,
3-N-methyl-N-amylamino-6-methyl-7-anilinofluoran,
3-N-methyl-N-cyclohexylamino-6-methyl-7-anilinofluoran,
3-diethylamino-6-methyl-7-anilinofluoran,
3-(N,N-diethylamino)-5-methyl-7-(N,N-dibenzylamino)fluoran,
benzoyl leuco methylene blue,
6'-chloro-8'-methoxy-benzoindolino-spiropyran,
6'-bromo-3'-methoxy-benzoindolino-spiropyran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide,
3-(2'-methoxy-4'-dimethylaminophenyl)-3-(2'-hydroxy-4'-chloro-5'-methylphenyl)phthalide,
3-morpholino-7-(N-propyl-trifluoromethylanilino)fluoran,
3-pyrrolidino-7-trifluoromethylanilinofluoran,
3-diethylamino-5-chloro-7-(N-benzyl-trifluoromethylanilino)fluoran,
3-pyrrolidino-7-(di-p-chlorophenyl)methylaminofluoran,
3-diethylamino-5-chloro-7-(α-phenylethylamino)fluoran,
3-(N-ethyl-p-toluidino)-7-(α-phenylethylamino)fluoran,
3-diethylamino-7-(o-methoxycarbonylphenylamino)fluoran,
3-diethylamino-5-methyl-7-(α-phenylethylamino)fluoran,
3-diethylamino-7-piperidinofluoran,
2-chloro-3-(N-methyltoluidino)-7-(p-n-butylanilino)fluoran,
3-(N-benzyl-N-cylcohexylamino)-5,6-benzo-7-α-naphthylamino-4'-bromofluoran and
3-diethylamino-6-methyl-7-mesidino-4',5'-benzofluoran.

As the color developers for use in combination with the above leuco dyes in the present invention, a variety of electron acceptors can be employed, for instance, phenolic materials, organic and inorganic acids, salts and esters of the acids, which react with the above leuco dyes when heat is applied thereto to induce color formation in the leuco dyes.

Specific examples of the above color developers are as follows: gallic acid, salicylic acid, 3-isopropylsalicylic acid, 3-cyclohexylsalicylic acid, 3,5-di-tert-butylsalicylic acid, 3,5-di-α-methylbenzylsalicylic acid, 4,4'-isopropylidenediphenol, 4,4'-isopropylidenebis(2-chlorophenol), 4,4'-isopropylidenebis(2,6-dibromophenol), 4,4'-isopropylidenebis(2,6-dichlorophenol), 4,4'-isopropylidenebis(2-methylphenol), 4,4'-isopropylidenebis(2,6-dimethylphenol), 4,4'-isopropylidenebis(2-tert-butylphenol), 4,4'-sec-butylidenediphenol, 4,4'-cyclohexylidenebisphenol, 4,4'-cyclohexylidenebis(2-methylphenol), 4-tert-butylphenyl, 4-phenylphenol, 4-hydroxy-diphenoxide, α-naphthol, β-naphthol, 3,5-xylenol, thymol, methyl 4-hydroxybenzoate, 4-hydroxyacetophenone, novolak-type phenolic resin, 2,2'-thiobis(4,6-dichlorophenol), catechol, resorcinol, hydroquinone, pyrogallol, phloroglucine, phloroglucinocarboxylic acid, 4-tert-octylcatechol, 2,2'-methylenebis(4-chlorophenol), 2,2'-methlenebis(4-methyl-6-tert-butylphenol), 2,2'-dihydroxydiphenyl, ethyl p-hydroxybenzoate, propyl p-hydroxybenzoate, butyl p-hydroxybenzoate, benzyl p-hydroxybenzoate, p-chlorobenzyl p-hydroxybenzoate, o-chlorobenzyl p-hydroxybenzoate, p-methylbenzyl p-hydroxybenzoate, n-octyl p-hydroxybenzoate, benzoic acid, zinc salicylate, 1-hydroxy-2-naphthoic acid, 2-hydroxy-6-naphthoic acid, zinc 2-hydroxy-6-naphthoate, 4-hydroxy diphenyl sulfone, 4-hydroxy-4'-chlorodiphenyl sulfone, bis(4-hydroxyphenyl)sulfide, 2-hydroxy-p-toluic acid, zinc 3,5-di-tert-butylsalicylate, tin 3,5-di-tert-butylsalicylate, tartalic acid, oxalic acid, maleic acid, citric acid, succinic acid, stearicaacid, 4-hydroxy phthalic acid and boric acid.

Further in the present invention, auxiliary additive components which are employed in the conventional thermosensitive recording materials, such as fillers, surface active agents, thermofusible materials and ungents, can be employed together with the above mentioned leuco dyes and color developers. As such fillers, the same fillers as those employed in the undercoat layers can be used.

The thermosensitive recording material according to the present invention can be prepared, for example, by successively applying a plurality of undercoat layer coating compositions and a thermosensitive recording layer coating composition to an appropriate support material such as paper, synthetic paper or plastic film, and drying the applied liquids. The thus prepared thermosensitive recording material can be employed for recording in a wide variety of fields.

By referring to the following examples, the present invention will now be explained in detail.

Preparation of Undercoat Layer Coating Compositions

Undercoat layer coating compositions A, B and C were separately prepared by grinding and dispersing the following respective components in a sand grinder for 30 minutes:

| | Parts by Weight |
|---|---|
| [Undercoat Layer Coating Composition A] | |
| Calcium carbonate | 20 |
| 10% aqueous solution of polyvinyl alcohol | 20 |
| Water | 60 |
| [Undercoat Layer Coating Composition B] | |
| 40% paraffin wax emulsion | 50 |
| 10% aqueous solution of polyvinyl alcohol | 40 |
| Water | 10 |
| [Undercoat Layer Coating Composition C] | |
| 40% polystyrene emulsion | 50 |
| 10% aqueous solution of polyvinyl alcohol | 20 |
| Water | 30 |
| [Undercoat Layer Coating Composition D] | |
| Undercoat Layer Coating Compositions A and B were mixed in a ratio by weight of 1:1, so that an undercoat layer coating composition D was prepared. | |
| [Undercoat Layer Coating Composition E] | |
| Undercoat Layer Coating Compositions A and C were mixed in a ratio by weight of 1:1, so that an undercoat layer coating composition E was prepared. | |

Preparation of Thermosensitive Recording Layer Coating Composition H

A dispersion F and a dispersion G were separately prepared by grinding and dispersing the following respective components in a sand grinder for 4 hours:

| | Parts by Weight |
|---|---|
| [Dispersion F] | |
| 3-(N—methyl-N—cyclohexylamino)-7-anilinofluoran | 20 |
| 10% aqueous solution of polyvinyl alcohol | 20 |
| Water | 60 |
| [Dispersion G] | |
| 1,7-di(4-hydroxyphenylthio)-3,5-dioxaheptane | 10 |
| Calcium carbonate | 10 |
| Zinc sterate | 3 |
| 10% aqueous solution of polyvinyl alcohol | 20 |
| Water | 57 |

The dispersion F and the dispersion G were mixed in a ratio by weight of 1:8, so that a thermosensitive recording layer coating composition H was prepared.

EXAMPLE 1

The undercoat layer coating composition A was coated on a sheet of commercially available high quality paper (having a basis weight of 52 g/m$^2$) with a coating weight of 4 g/m$^2$ when dried, whereby a first undercoat layer was formed on the high quality paper.

The undercoat layer coating composition A was again coated on the above mentioned first undercoat layer with a coating weight of 4 g/m$^2$ when dried, whereby a second undercoat layer was formed on the first undercoat layer.

The thermosensitive recording layer coating composition H was coated on the second undercoat layer with a coating weight of 5.0 g/m$^2$ when dried. Thus, a thermosensitive recording material was prepared. This was then subjected to calendering, so that the surface of the thermosensitive recording layer was made smooth to the extent ranging from 500 seconds to 1000 seconds in terms of Bekk's smoothness, whereby a thermosensitive recording material No. 1 according to the present invention was prepared.

EXAMPLE 2

Example 1 was repeated except that the second undercoat layer was formed by the undercoat layer coating composition C, whereby a thermosensitive recording material No. 2 according to the present invention was prepared.

EXAMPLE 3

Example 1 was repeated except that the first undercoat layer was formed by the undercoat layer coating composition D and the second undercoat layer was formed by the undercoat layer coating composition C, whereby a thermosensitive recording material No. 3 according to the present invention was prepared.

EXAMPLE 4

Example 1 was repeated except that the first undercoat layer was formed by the undercoat layer coating composition B and the second undercoat layer was formed by the undercoat layer coating composition C, whereby a thermosensitive recording material No. 4 according to the present invention was prepared.

EXAMPLE 5

Example 1 was repeated except that the first undercoat layer was formed by the undercoat layer coating composition b, whereby a thermosensitive recording material No. 5 according to the present invention was prepared.

Comparative Example 1

Example 1 was repeated except that the first undercoat layer was formed by the undercoat layer coating composition E and the second undercoat layer was not formed, whereby a comparative thermosensitive recording material No. 1 was formed.

Comparative Example 2

Example 1 was repeated except that no undercoat layers were formed, whereby a comparative thermosensitive recording material No. 2 was formed.

The following table 1 summarizes the structures of the above thermosensitive recording materials according to the present invention and the comparative thermosensitive recording materials.

TABLE 1

| | Undercoat Layers | | Thermosensitive Recording Layer |
|---|---|---|---|
| | First Coating Composition ($g/m^2$) | Second Coating Composition ($g/m^2$) | Coating Composition ($g/m^2$) |
| Ex. 1 | A (4.0) | A (4.0) | H (5.0) |
| Ex. 2 | A (4.0) | C (4.0) | H (5.0) |
| Ex. 3 | D (4.0) | C (4.0) | H (5.0) |
| Ex. 4 | B (4.0) | C (4.0) | H (5.0) |
| Ex. 5 | B (4.0) | A (4.0) | H (5.0) |
| Comp. Ex. 1 | E (8.0) | — | H (5.0) |
| Comp. Ex. 2 | — | — | H (5.0) |

The thermosensitive recording materials No. 1 through No. 5 according to the present invention and the comparative thermosensitive recording materials No. 1 and No. 2 were subjected to thermal printing by use of a thermal printing test apparatus including a thermal head (made by Matsushita Electronic Components Co., Ltd.) under the conditions that the power applied to the head was 0.45 W/dot, the recording time per line was 20 msec, the scanning line density was $8\times3.85$ dots/mm, with the pulse width applied thereto changed to 6 steps of 0.8 msec, 1.0 msec, 1.2 msec, 1.4 msec, 1.6 msec and 1.8 msec. The density of the developed images were measured by Macbeth densitometer RD-514 with a filter W-106. The results are shown in the following Table 2.

TABLE 2

| | Developed Image Density Pulse width (msec) | | | | | | Back-Ground |
|---|---|---|---|---|---|---|---|
| | 0.8 | 1.0 | 1.2 | 1.4 | 1.6 | 1.8 | Density |
| Ex. 1 | 0.32 | 0.65 | 0.96 | 1.12 | 1.24 | 1.31 | 0.07 |
| Ex. 2 | 0.35 | 0.67 | 0.98 | 1.13 | 1.26 | 1.32 | 0.07 |
| Ex. 3 | 0.36 | 0.69 | 0.99 | 1.13 | 1.27 | 1.32 | 0.07 |
| Ex. 4 | 0.34 | 0.66 | 0.98 | 1.13 | 1.26 | 1.32 | 0.07 |
| Ex. 5 | 0.33 | 0.66 | 0.96 | 1.12 | 1.24 | 1.31 | 0.07 |
| Comp. Ex. 1 | 0.31 | 0.64 | 0.94 | 1.11 | 1.23 | 1.31 | 0.09 |
| Comp. Ex. 2 | 0.17 | 0.45 | 0.78 | 0.95 | 1.12 | 1.27 | 0.11 |

The above results indicate that the thermosensitive recording materials according to the present invention have higher thermal recording sensitivity and lower background density as compared with the comparative thermosensitive recording materials. Therefore, they are suitable for high speed recording and can be employed in a variety of applications, including thermosensitive recording labels and magnetic tickets.

What is claimed is:

1. A thermosensitive recording material capable of yielding images thereon by image-wise application of heat thereto comprising:

(a) a support material;

(b) a plurality of undercoat layers overlaid on said support material, each undercoat layer being different and being selected from the group consisting of an undercoat layer (A) comprising a finely-divided filler having an average particle size of 5 μm or less, and a binder agent, and an undercoat layer (B) comprising a wax or wax-like material which can be plastically formed when pressure is applied thereto, and a binder agent; and (c) a thermosensitive recording layer formed on said undercoat layer, said thermosensitive recording layer comprising one or more leuco dyes and a color developer capable of inducing color formation in said leuco dye when heat is applied thereto.

2. The thermosensitive recording material as claimed in claim 1, wherein said plurality of different undercoat layers is selected from the group consisting of:

an undercoat layer (A) comprising a finely-divided filler having an average particle size of 5 μm or less, and a binder agent, an undercoat layer (B) comprising a material which can be plastically deformed when pressure is applied thereto, and further comprising a binder agent, and an undercoat layer (C1) comprising a filler whose particles are spherical and uniform in particle size, and a binder agent.

3. The thermosensitive recording material as claimed in claim 2, wherein said binder agent contained in said undercoat layers (A), (B), (C1) and (C2) is selected from the group consisting of polyvinyl alcohol, starch, starch derivatives, methoxycellulose, hydroxyethylcellulose, carboxymethylcellulose, methylcellulose, ethylcellulose, sodium polyacrylate, polyvinyl pyrrolidone, polyacrylamide/acrylic acid ester copolymer, acrylamide/acrylic acid ester/methacrylic acid copolymer, styrene/maleic anhydride copolymer alkali salt, isobutylene/maleic anhydride copolymer alkali salt, polyacrylamide, sodium alginate, gelatin and casein, and latexes of polyvinyl acetate, polyurethane, styrene/butadiene copolymer, polyacrylic acid, polyacrylic acid ester, vinyl chloride/vinyl acetate copolymer, polybutylmethacrylate, ethylene/vinyl acetate copolymer and styrene/butadiene/acrylic derivative copolymer.

4. The thermosensitive recording material as claimed in claim 2, wherein said finely-divided filler contained in said undercoat layer (A) is selected from the group consisting of calcium carbonate, silica, zinc oxide, titanium oxide, aluminum hydroxide, zinc hydroxide, barium sulfate, clay, talc, surface-treated calcium carbonate, surface-treated silica, urea-formaldehyde resin, styrene/methacrylic acid copolymer and polystyrene.

5. The thermosensitive recording material as claimed in claim 2, wherein said finely-divided filler contained in said undercoat layer (C1) is selected from the group consisting of a styrene-methacrylic acid copolymer filler and a polystyrene filler.

6. The thermosensitive recording material as claimed in claim 1, wherein said plurality of different undercoat layers is selected from the group consisting of:

an undercoat layer (A) comprising a finely-divided filler having an average particle size of 5 μm or less, and a binder agent, an undercoat layer (B) comprising a material which can be plastically deformed when pressure is applied thereto, and further comprising a binder agent, and an undercoat layer (C2) comprising a filler having low thermal conductivity and a binder agent.

7. The thermosensitive recording material as claimed in claim 6, wherein said filler contained in said undercoat layer (C2) comprises fine, hollow particles made of a material selected from the group consisting of glass, ceramics and plastics.

8. The thermosensitive recording material as claimed in claim 1, wherein said plurality of different undercoat layers is selected from the group consisting of:

an undercoat layer (A+B) comprising a finely-divided filler having an average particle size of 5 μm or less, a material which can be plastically deformed when pressure is applied thereto, and further comprising a binder agent, and an undercoat layer (C1) comprising a filler whose particles are spherical and uniform in particle size, and a binder agent.

9. The thermosensitive recording material as claimed in claim 1, wherein said plurality of different undercoat layers is selected from the group consisting of:

an undercoat layer (A+B) comprising a finely-divided filler having an average particle size of 5 μm or less, a material which can be plastically deformed when pressure is applied thereto, and further comprising a binder agent, and an undercoat layer (C2) comprising a filler having low thermal conductivity and a binder agent.

10. The thermosensitive recording material as claimed in claim 1, wherein said plurality of different undercoat layers each is selected from the group consisting of:

an undercoat layer (A) comprising a finely-divided filler having an average particle size of 5 μm or less, and further comprising (C1) comprising a filler whose particles are spherical and uniform in particle size, and a binder agent, and an undercoat layer (B) comprising a material which can be plastically deformed when pressure is applied thereto, and a binder agent.

11. The thermosensitive recording material as claimed in claim 1, wherein said plurality of different undercoat layers each is selected from the group consisting of:

an undercoat layer (A) comprising a finely-divided filler having an average particle size of 5 μm or less, and further comprising (C2) comprising a filler having low thermal conductivity, a binder agent, and an undercoat layer (B) comprising a material which can be plastically deformed when pressure is applied thereto, and a binder agent.

12. The thermosensitive recording material as claimed in claim 1, wherein said plurality of different undercoat layers each is selected from the group consisting of:

an undercoat layer (A) comprising a finely-divided filler having an average particle size of 5 μm or less, and a binder agent, an undercoat layer (B) comprising a material which can be plastically deformed when pressure is applied thereto, and further comprising (C1) comprising and a filler whose particles are spherical and uniform in particle size, and a binder agent.

13. The thermosensitive recording material as claimed in claim 1, wherein said plurality of different undercoat layers each is selected from the group consisting of:

an undercoat layer (A) comprising a finely-divided filler having an average particle size of 5 μm or less, and a binder agent, an undercoat layer (B) comprising a material which can be plastically deformed when pressure is applied thereto, and further comprising (C2) comprising and a filler having low thermal conductivity, and a binder agent.

14. The thermosensitive recording material as claimed in claim 1, wherein at least one of said undercoat layers comprises:

(a) a wax selected from the group consisting of a vegetable wax, and a petroleum wax; or a synthetic wax selected from the group consisting of polyhydric alcohol esters of higher fatty acids, higher fatty ketones, higher fatty amines, higher fatty amides, condensates of higher fatty acids and amines, synthetic paraffin and paraffin chloride; and (b) a binder.

* * * * *